US010062334B2

(12) United States Patent
You et al.

(10) Patent No.: US 10,062,334 B2
(45) Date of Patent: Aug. 28, 2018

(54) BACKLIGHT DIMMING CONTROL FOR A DISPLAY UTILIZING QUANTUM DOTS

(71) Applicant: Apple Inc., Cupertino, CA (US)

(72) Inventors: Chenhua You, San Jose, CA (US); Jean-Jacques P. Drolet, San Jose, CA (US)

(73) Assignee: Apple Inc., Cupertino, CA (US)

( * ) Notice: Subject to any disclaimer, the term of this patent is extended or adjusted under 35 U.S.C. 154(b) by 71 days.

(21) Appl. No.: 13/665,616

(22) Filed: Oct. 31, 2012

(65) Prior Publication Data

US 2014/0035960 A1 Feb. 6, 2014

Related U.S. Application Data

(60) Provisional application No. 61/677,926, filed on Jul. 31, 2012.

(51) Int. Cl.

| | |
|---|---|
| ***G09G 5/00*** | (2006.01) |
| ***F21V 7/04*** | (2006.01) |
| ***G09G 3/34*** | (2006.01) |

(52) U.S. Cl.

CPC ... *G09G 3/3413* (2013.01); *G09G 2320/0242* (2013.01); *G09G 2320/045* (2013.01); *G09G 2320/064* (2013.01); *G09G 2330/021* (2013.01)

(58) Field of Classification Search

CPC ..... G09G 3/22; G09G 3/3208; G09G 3/30; G09G 3/3225; G09G 3/3233; G09G 3/3241; G09G 3/3266; G09G 3/3275; G09G 3/3258

See application file for complete search history.

(56) References Cited

U.S. PATENT DOCUMENTS

| | | | |
|---|---|---|---|
| 5,483,261 | A | 1/1996 | Yasutake |
| 5,488,204 | A | 1/1996 | Mead et al. |
| 5,825,352 | A | 10/1998 | Bisset et al. |
| 5,835,079 | A | 11/1998 | Shieh |

(Continued)

FOREIGN PATENT DOCUMENTS

| | | | |
|---|---|---|---|
| JP | 2000-163031 | A | 6/2000 |
| JP | 2002-342033 | A | 11/2002 |

OTHER PUBLICATIONS

Lee, S.K. et al. (Apr. 1985). "A Multi-Touch Three Dimensional Touch-Sensitive Tablet," *Proceedings of CHI: ACM Conference on Human Factors in Computing Systems*, pp. 21-25.

(Continued)

*Primary Examiner* — William Lu

(74) *Attorney, Agent, or Firm* — Morrison & Foerster LLP

(57) ABSTRACT

Quantum dot backlights for use in displays and processes for controlling the dimming of quantum dot backlights are provided. The backlight can include an LED (e.g., a blue LED) configured to emit a light through a sheet of quantum dots. The quantum dots can be configured to emit colored light (e.g., red and green light) in response to the light emitted from the LED. To control the relative luminance of the LED, the backlight can be controlled through the use of current dimming to adjust the brightness of the LED at high relative luminance settings to increase the light output efficiency and can include the use of pulse width modulation to adjust the brightness of the LED at low relative luminance settings to reduce the amount of wavelength shift experienced by the LED.

19 Claims, 12 Drawing Sheets

(56) References Cited

U.S. PATENT DOCUMENTS 5,880,411 A 3/1999 Gillespie et al.
6,048,630 A * 4/2000 Burrows ..... C09K 11/06 313/504
6,188,391 B1 2/2001 Seely et al.
6,310,610 B1 10/2001 Beaton et al.
6,323,846 B1 11/2001 Westerman et al.
6,690,387 B2 2/2004 Zimmerman et al.
6,950,220 B2 * 9/2005 Abramson ..... G02F 1/15 359/265
7,015,894 B2 3/2006 Morohoshi
7,184,064 B2 2/2007 Zimmerman et al.
7,663,320 B2 * 2/2010 Kim et al. ..... 315/156
7,663,607 B2 2/2010 Hotelling et al.
8,033,706 B1 * 10/2011 Kelly ..... G02B 6/0036 362/307
8,179,034 B2 * 5/2012 Potts ..... B82Y 20/00 313/504
8,278,846 B2 * 10/2012 Roberts et al. ..... 315/308
8,479,122 B2 7/2013 Hotelling et al.
2006/0026521 A1 2/2006 Hotelling et al.
2006/0197753 A1 9/2006 Hotelling
2007/0115662 A1 * 5/2007 Roberts et al. ..... 362/252
2007/0276455 A1 * 11/2007 Fiset ..... A61C 19/066 607/91
2008/0065345 A1 * 3/2008 Ooghe ..... 702/130
2008/0088243 A1 * 4/2008 Kim et al. ..... 315/151
2008/0158441 A1 * 7/2008 Yamamuro et al. ..... 348/759
2008/0258695 A1 * 10/2008 Kumar ..... H05B 33/0818 323/223
2009/0015526 A1 * 1/2009 Ramanath ..... G09G 3/3413 345/84
2009/0086170 A1 * 4/2009 El-Ghoroury ..... B82Y 20/00 353/38
2009/0179848 A1 * 7/2009 Schmidt et al. ..... 345/102
2009/0219244 A1 * 9/2009 Fletcher et al. ..... 345/102
2010/0072901 A1 * 3/2010 De Rijck ..... H05B 33/0818 315/152
2010/0220042 A1 * 9/2010 Ei-Ghoroury et al. ..... 345/83
2010/0295860 A1 * 11/2010 Somerville et al. ..... 345/545
2010/0295861 A1 * 11/2010 Somerville et al. ..... 345/545
2011/0050658 A1 * 3/2011 White et al. ..... 345/205
2011/0062872 A1 * 3/2011 Jin et al. ..... 315/122
2012/0050644 A1 * 3/2012 Jeong ..... H01L 33/40 349/62
2012/0068978 A1 * 3/2012 Aitken ..... G09G 3/3406 345/207
2012/0075360 A1 * 3/2012 Messmer ..... 345/690
2012/0086701 A1 * 4/2012 Vaananen ..... H05B 33/0848 345/214
2012/0113671 A1 * 5/2012 Sadasivan et al. ..... 362/602
2012/0113672 A1 * 5/2012 Dubrow ..... B82Y 20/00 362/602
2012/0154462 A1 * 6/2012 Hempson et al. ..... 345/691
2013/0070472 A1 * 3/2013 Maxik ..... F21V 9/30 362/554
2013/0147777 A1 * 6/2013 Lau ..... G02B 26/00 345/207
2013/0229114 A1 * 9/2013 Eisele et al. ..... 315/152

OTHER PUBLICATIONS

Rubine, D.H. (Dec. 1991). "The Automatic Recognition of Gestures," CMU-CS-91-202, Submitted in Partial Fulfillment of the Requirements for the Degree of Doctor of Philosophy in Computer Science at Carnegie Mellon University, 285 pages.
Rubine, D.H. (May 1992). "Combining Gestures and Direct Manipulation," CHI ' 92, pp. 659-660.
Westerman, W. (Spring 1999). "Hand Tracking, Finger Identification, and Chordic Manipulation on a Multi-Touch Surface," A Dissertation Submitted to the Faculty of the University of Delaware in Partial Fulfillment of the Requirements for the Degree of Doctor of Philosophy in Electrical Engineering, 364 pages.

* cited by examiner

Graph
400

Graph
500

Process 600

Process
700

BACKLIGHT DIMMING CONTROL FOR A DISPLAY UTILIZING QUANTUM DOTS

FIELD

This relates generally to backlight dimming control and, more specifically, backlight dimming control for a display utilizing quantum dots (QDs).

BACKGROUND

Display screens of various types of technologies, such as liquid crystal displays (LCDs), organic light emitting diode (OLED) displays, etc., can be used as screens or displays for a wide variety of electronic devices, including such consumer electronics as televisions, computers, and handheld devices (e.g., mobile telephones, tablet computers, audio and video players, gaming systems, and so forth). LCD devices, for example, typically provide a flat display in a relatively thin package that is suitable for use in a variety of electronic goods. In addition, LCD devices typically use less power than comparable display technologies, making them suitable for use in battery-powered devices or in other contexts where it is desirable to minimize power usage.

Liquid crystal displays generally include a backlight that provides visible light to a liquid crystal layer, which takes the light from the backlight and controls the brightness and color at each individual pixel in the display in order to render a desired image.

The backlight often contains light emitting diodes that are coated with a phosphor, such as Yttrium Aluminum Garnet (YAG), in order to produce a white light, which the liquid crystal layer then uses to render desired colors for the display. In other backlight devices, the phosphor can be replaced with quantum dots that are configured to emit light at various wavelengths. One metric that can be used to judge the quality of a display is the uniformity of color generated by the display over varying levels of brightness. In some displays, the current used to drive the display can be increased or decreased based on the desired display brightness. However, in quantum dot displays, a change in driving current can result in a shift in the wavelength or color of the light produced by the display. Another metric that can be used to judge the quality of a display is the power efficiency of the display. Thus, it can be desirable to have an energy efficient display that experiences reduced shift in wavelength over various drive current levels.

SUMMARY

This relates to quantum dot backlights for use in displays (e.g., LED, OLED displays, and the like) and processes for controlling the dimming of quantum dot backlights. The backlight can include a blue LED configured to emit blue light through a sheet of quantum dots. The quantum dots can be configured to emit red and green light in response to the light emitted from the blue LED. Thus, the red and green light emitted from the quantum dots can be mixed with the light from a blue LED that is passed through the quantum dot sheet to form white light. To control the relative luminance, or light intensity, the backlight can be controlled through the use of current dimming (e.g., increasing or decreasing a forward current through the LED) to adjust the brightness of an LED in a backlight at high relative luminance settings to increase the light output efficiency and can include the use of pulse width modulation to adjust the brightness of the LED at low relative luminance settings to reduce the amount of wavelength shift experienced by the LED.

DETAILED DESCRIPTION

In the following description of the disclosure and examples, reference is made to the accompanying drawings in which it is shown by way of illustration specific examples that can be practiced. It is to be understood that other examples can be practiced and structural changes can be made without departing from the scope of the disclosure.

This relates to quantum dot backlights for use in displays (e.g., LED, OLED displays, and the like) and processes for controlling the dimming of quantum dot backlights. The backlight can include a blue LED configured to emit blue light through a sheet of quantum dots. The quantum dots can be configured to emit red and green light in response to the light emitted from the blue LED. Thus, the red and green light emitted from the quantum dots can be mixed with the light from a blue LED that is passed through the quantum dot sheet to form white light. To control the relative luminance, or light intensity, the backlight can be controlled through the use of current dimming (e.g., increasing or decreasing a forward current through the LED) to adjust the brightness of an LED in a backlight at high relative luminance settings to increase the light output efficiency and can include the use of pulse width modulation to adjust the brightness of the LED at low relative luminance settings to reduce the amount of wavelength shift experienced by the LED.

Although examples disclosed herein may be described and illustrated herein in terms of displays that utilize side emitting LEDs, it should be understood that the examples are not so limited, but are additionally applicable to top emitting LEDs or bottom emitting LEDs. Furthermore, although examples may described in terms of displays, it should be understood that the examples are not so limited, but are additionally applicable to displays that are integrated with touch screens which can accept touch inputs from a user or object, such as a stylus.

Figure 1A:
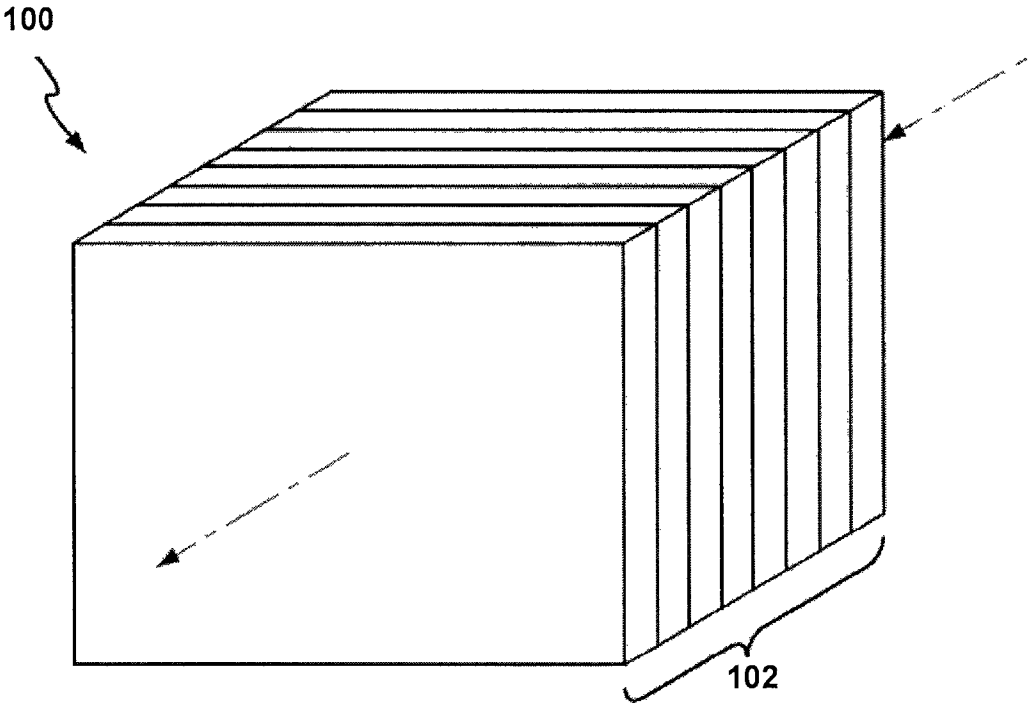
FIG. 1A illustrates an exemplary display screen stack-up according to some disclosed examples.
Figure 1B:
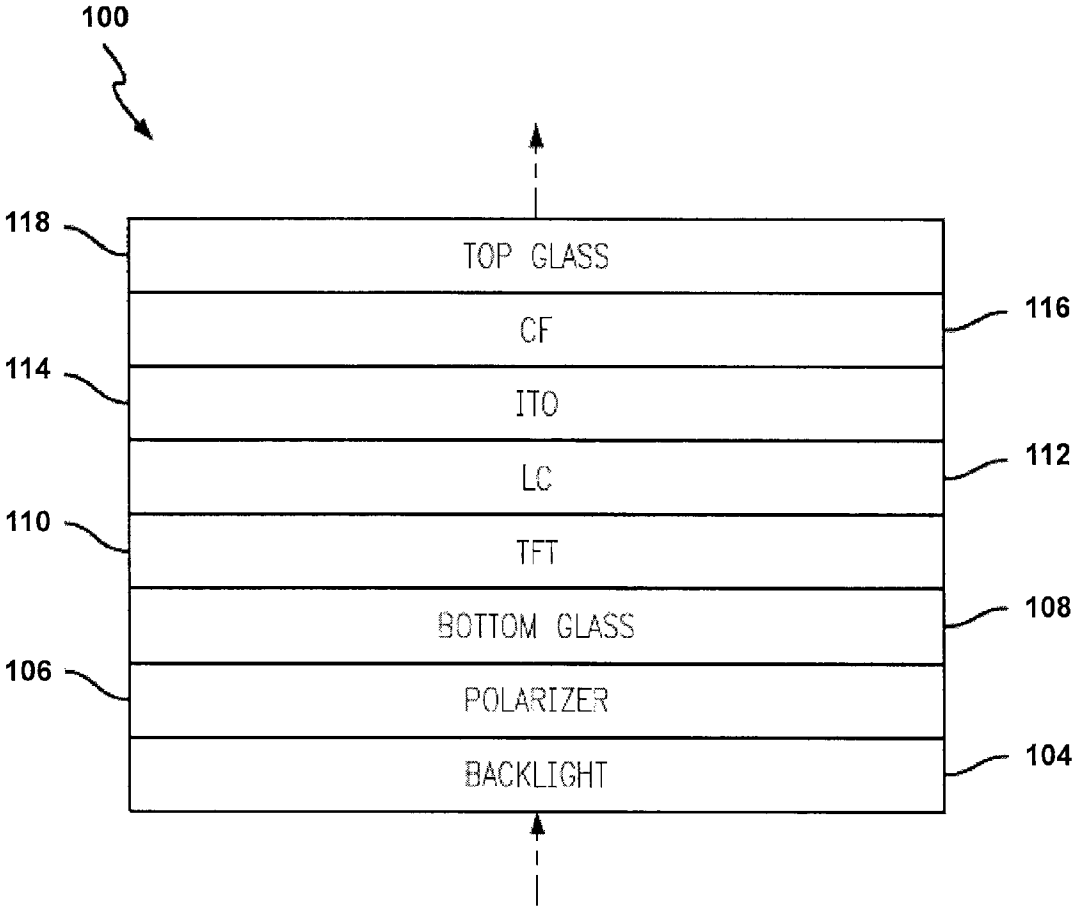
FIG. 1B illustrates exemplary layers of an LCD display screen stack-up according to some disclosed examples.

FIG. 1A illustrates an exemplary display screen stack-up in which a backlight controlled using backlight dimming controls according to various examples can be used. Display screen 100 can be any type of display, such as an LCD, OLED display, or the like, and can include series of layers 102 that can be bonded together to constitute the display. FIG. 1B illustrates one exemplary type of display in which a backlight (e.g., a quantum dot backlight) according to various examples can be used. Specifically, FIG. 1B illustrates exemplary layers of an LCD display screen stack-up according to some disclosed examples. Stack 100 can include backlight 104 for providing white light that can be directed towards the aperture of the stack-up. As will be discussed below, the backlight can supply the rest of the display stack-up with light that can be oriented in particular orientation based on the needs of the rest of the stack-up. In order to control the brightness of the light, the white light produced by the backlight 104 can be fed into a polarizer 106 that can impart polarity to the light. The polarized light coming out of polarizer 106 can be fed through bottom glass 108 into a liquid crystal layer 112 that can be sandwiched between an Indium Tin Oxide (ITO) layer 114 and a Thin Film Transistor (TFT) layer 110. TFT substrate layer 110 can contain the electrical components necessary to create the electric field, in conjunction with ITO layer 114 that can drive the liquid crystal layer 112. More specifically, TFT substrate 110 can include various different layers that can include display elements, such as data lines, gate lines, TFTs, common and pixel electrodes, etc. These components can help create a controlled electric field that can orient liquid crystals located in liquid crystal layer 112 into a particular orientation, based on the desired color to be displayed at any particular pixel. The orientation of a liquid crystal element in liquid crystal layer 112 can alter the orientation of the polarized light that is passed through it from backlight 104. The altered light from liquid crystal layer 112 can then be passed through color filter layer 116. Color filter layer 116 can contain a polarizer. The polarizer in color filter layer 116 can interact with the polarized light coming from liquid crystal layer 112, whose orientation can be altered depending on the electric field applied across the liquid crystal layer. The amount of light allowed to pass through color filter layer 116 into top glass 118 can be determined by the orientation of the light as determined by the orientation of the liquid crystal layer 112. By polarizing the white light coming out of back light 104, changing the orientation of the light in liquid crystal layer 112, and then passing the light through a polarizer in color filter layer 116, the brightness of light can be controlled on a per pixel basis. Color filter layer 116 also can contain a plurality of color filters that can change the light passed through it into red, green and blue. By controlling the brightness and color of light on a per pixel basis, a desired image can be rendered on the display. Additionally, as discussed in greater detail below with respect to FIGS. 5-9, the amount of light generated by the backlight can also be adjusted to control the overall brightness and color of the entire display.

In some examples, a quantum dot backlight can be used for backlight 104. Quantum dots are tiny, nanocrystal phosphors that can be about 2-10 nm in size. They can be distinguished from bulk semiconductor material (used to fabricate LEDs) not only in size, but also by their energy levels. The energy levels in bulk material can be so close together that the levels are essentially continuous; however, quantum dots can contain only two discrete energy bands that can be occupied by the electrons. The valence band can be located below the bandgap and the conduction band can be located above the bandgap. When an electron in the valence band is imparted with sufficient energy to surmount the bandgap, it can become excited and jump to the conduction band. The electron will then want to return to its lowest energy state, and in doing so, can release energy in the form of electromagnetic radiation. The electron can fall back down to the valence band, emitting a photon with wavelength corresponding to the wavelength of radiation or the bandgap energy. For quantum dots, their small size leads to quantum confinement, where the energy levels can become discrete and quantized with finite separation. When the quantum dots are excited, the electromagnetic radiation corresponding to the wavelength can be released in the form of light. The main difference relative to bulk material is that the discrete energy levels for the QDs can allow for precise tunability of the emitted photon. For quantum dots, the energy levels can be finely tuned based on the size of the dot, which in turn can lead to tuning the wavelength of the emitted photon. This tunability can allow the QDs the ability to emit nearly any frequency of light, a quality that bulk semiconductor material, and hence a stand-alone, standard light-emitting diode (LED) lacks. The quantum dots can be tuned to emit colors at more precise wavelengths relative to YAG phosphors with narrower spectral emission and a smaller full width at half maximum (FWHM) bandwidth. The heightened spectral precision of quantum dots can allow the color filter in color filter layer 116 to be narrowed, thus improving both the color quality and color gamut of the display. Quantum dots can be formed on a sheet that is placed within the display, so that it can be exposed to the light produced by an LED.

Figure 2:
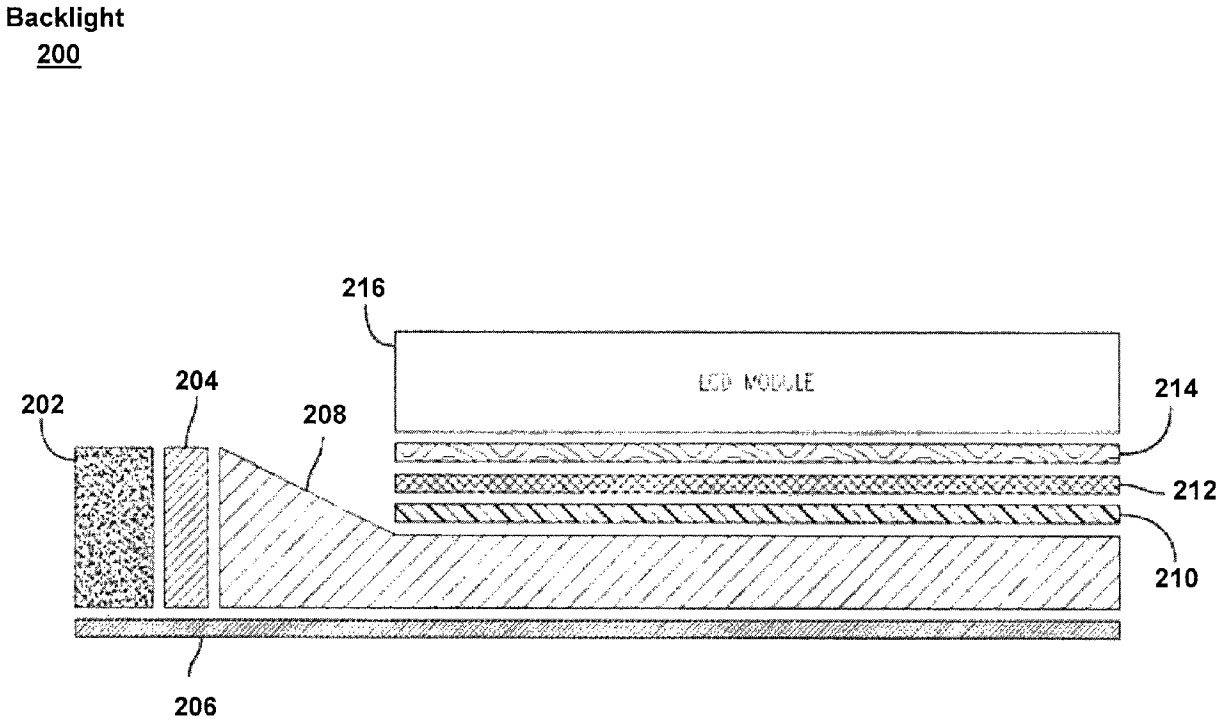
FIG. 2 illustrates an exemplary backlight, according to some disclosed examples.

FIG. 2 illustrates one exemplary quantum dot backlight 200 that can be used in stack 100. Backlight 200 can include plurality of elements that can be arranged so as to provide white light to the rest of display stack-up 100. Backlight 200 can contain light emitting diode (LED) 202, which can act as the primary light source for the entire display stack-up 100. As pictured, LED 202 can be a side emitting LED. The light generated by LED 202 can irradiate quantum dot sheet 204 that can produce a light of a particular color or colors when excited by light source, such as an LED. Quantum dot sheet 204 can include individual quantum dots arranged in groups, such that each group can contain, for example, 3 quantum dots, one red, one green and one blue, such that the light generated by each group when mixed together can produce white light. In other examples, a blue LED can be used to excite the quantum dots, obviating the need for a quantum dot that emits blue light, and thus the group of quantum dots may contain only a red and green quantum dot. Thus, the red and green light emitted from the quantum dots can be mixed with the light from a blue LED that is passed through the quantum dot sheet to form white light. Quantum dot sheet 204 can be excited by light generated by LED 202. In some examples, LED 202 can be operable to generate ultra violet (UV) light. The light generated by LED 202 can provide the energy required to excite the quantum dots so that they emit photons of light at precisely tuned wavelengths. The wavelengths can be tuned by adjusting the size of the quantum dots. When the light generated by LED 202 excites the quantum dots in sheet 204, each quantum dot can release light. An excited quantum dot may release isotropic light. In other words, the light emitted from a quantum dot will be emitted uniformly in all directions from the quantum dot.

The light emitted from quantum dot sheet 204 can be fed into light guide 208, which in conjunction with reflective plate 206 can work to turn the light being emitted from the side emitting LED 202 into the LCD module. The light that is emitted upwards toward the LCD module 216 can first enter prism sheet 210, which can act to turn the light further, so that it can enter the LCD module perpendicular to its bottom plane. The light that passes through prism sheet 210 can also be fed into a diffuser 212. Diffuser 212 can act to mix the red, green and blue light emitted from quantum dot sheet 204 in order to create white light. The mixed light from diffuser 212 can then be fed into a second prism sheet 214 that can again turn the direction of the light, so that it can enter the LCD module 216 perpendicularly.

Figure 3:
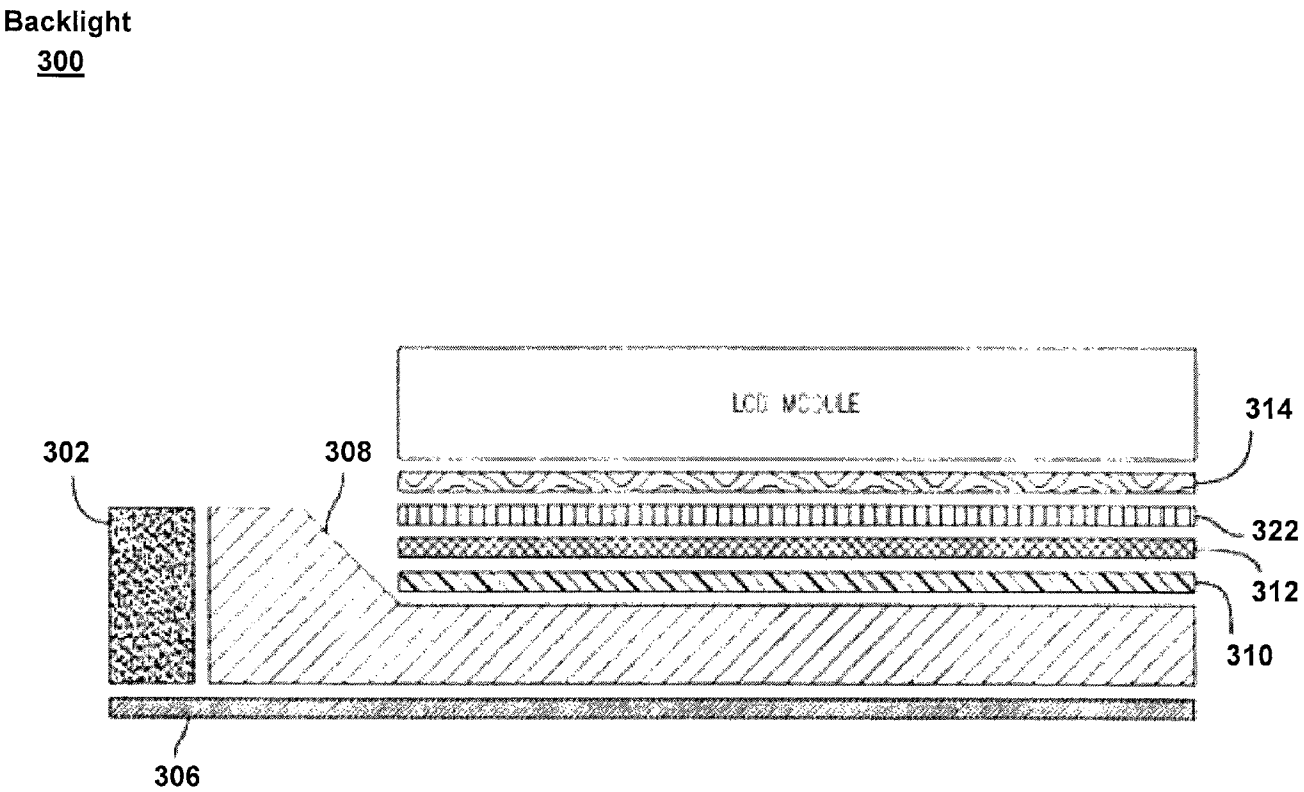
FIG. 3 illustrates another exemplary backlight, according to some disclosed examples.

FIG. 3 illustrates another exemplary quantum dot backlight 300 that can be used in stack 100. In this example, the quantum dot sheet 322 can be moved away from LED 302, and can be placed between diffuser 312 and prism sheet 314. While the quantum dot sheet 322 is illustrated in FIG. 3 as being placed between diffuser sheet 312 and prism sheet 314, in other examples prism sheet 310, diffuser sheet 312, quantum dot sheet 322 and prism sheet 314 can be arranged in other combinations or orders. Placing the quantum dot sheet 322 proximal to the diffuser and prism sheets can be advantageous in that the quantum dot sheet 322 is positioned further away from LED 322 and thus can be less susceptible to the effects of heat generated by the LED.

Figure 4:
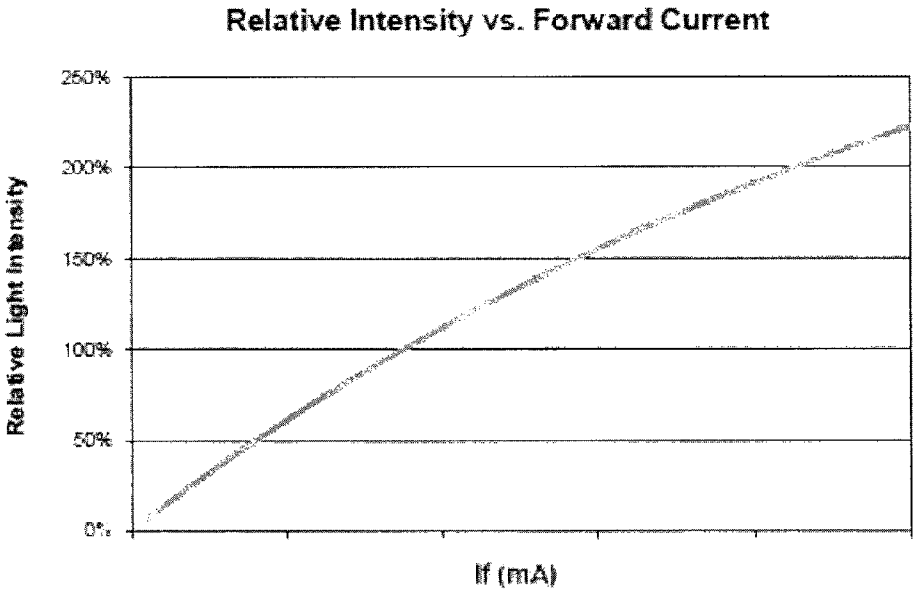
FIG. 4 illustrates an exemplary graph showing a relationship between relative light intensity and forward current of an LED according to some disclosed examples.
Figure 5:
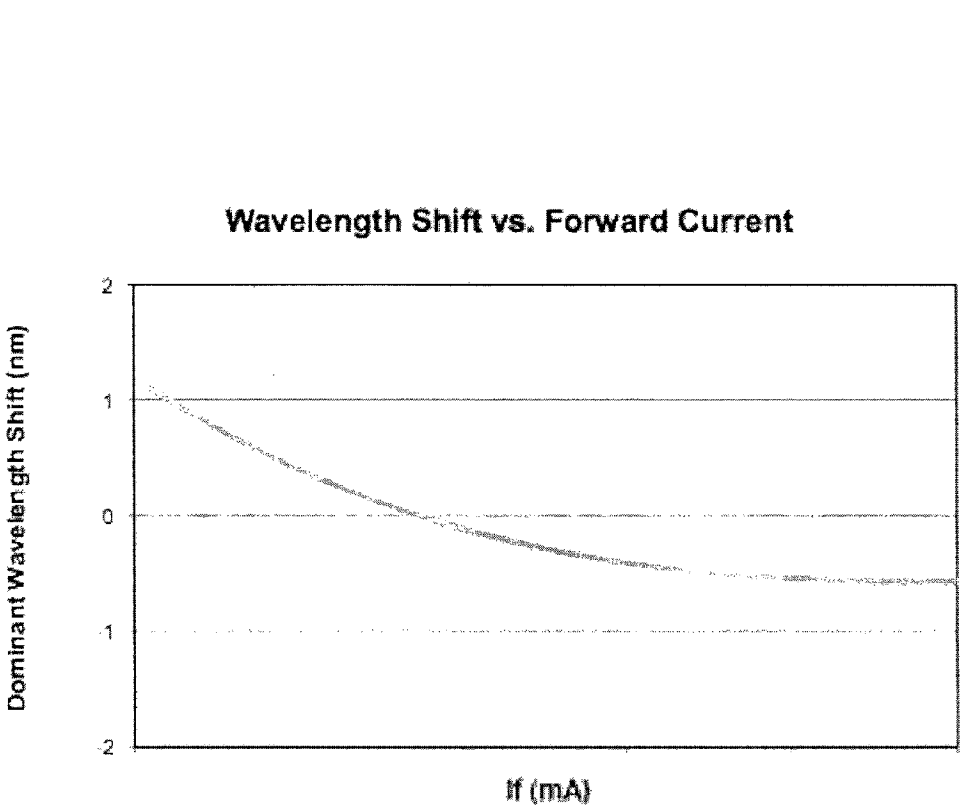
FIG. 5 illustrates an exemplary graph showing a relationship between dominant wavelength shift and forward current of an LED according to some disclosed examples.

To control the brightness of a display, the brightness of the light generated by a backlight LED, such as LED 202 or 302, can be adjusted. For example, FIG. 4 illustrates an exemplary graph showing a relationship between relative light intensity and forward current passing through an LED. Thus, to reduce the light intensity of the LED, and thus the intensity of light generated by a backlight, the drive current sent through the LED can be reduced. The drive current can be generated by drive circuitry known to those of ordinary skill in the art and can be controlled by a drive circuitry controller. However, when using a blue LED as LED 202 or 302, a change in forward current can undesirably cause a shift in wavelength of the light emitted by the LED. For example, FIG. 5 illustrates an exemplary graph showing a relationship between dominant wavelength shift and forward current of a blue LED. The dominant wavelength (e.g., color) of the emitted light can change as a function of forward current. In some examples, the amount of wavelength shift can be more pronounced at lower current levels. Thus, while drive current can be changed to adjust the brightness of a blue LED within a backlight, the change in drive current can result in a change in the color of the light emitted by the backlight, resulting in an undesired change in color of a display in which the backlight is used.

Figure 6:
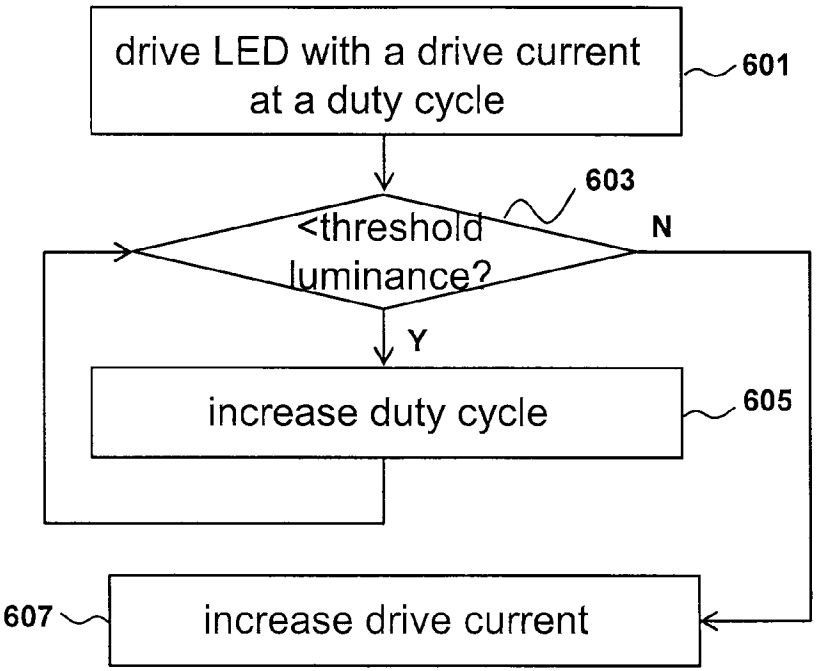
FIG. 6 illustrates an exemplary process for increasing a relative light intensity of a backlight according to examples of the present disclosure.
Figure 7:
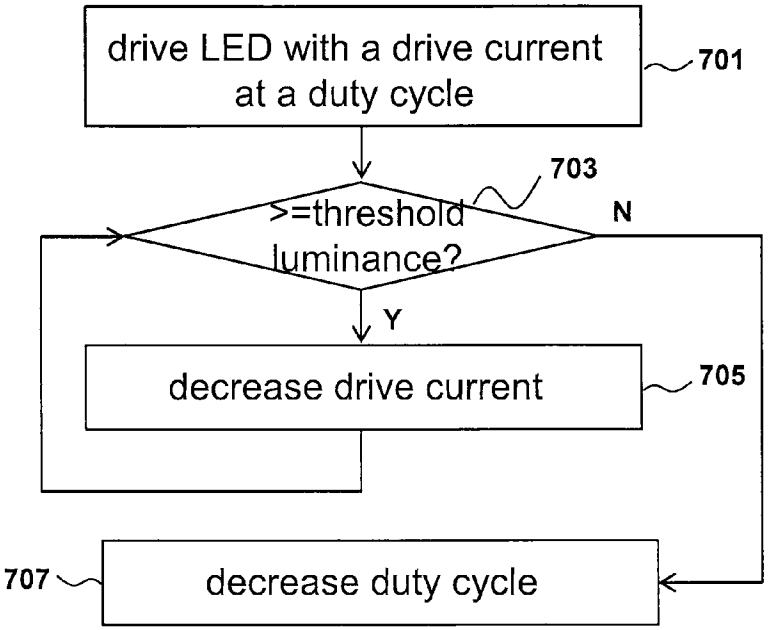
FIG. 7 illustrates an exemplary process for decreasing a relative light intensity of a backlight according to examples of the present disclosure.
Figure 8A:
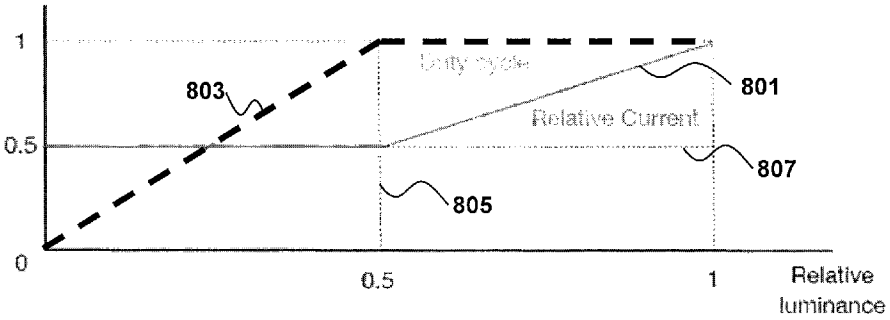
FIGS. 8A and 8B illustrate exemplary graphs showing example drive currents and duty cycles that may be used according to the processes of FIGS. 6 and 7.
Figure 8B:
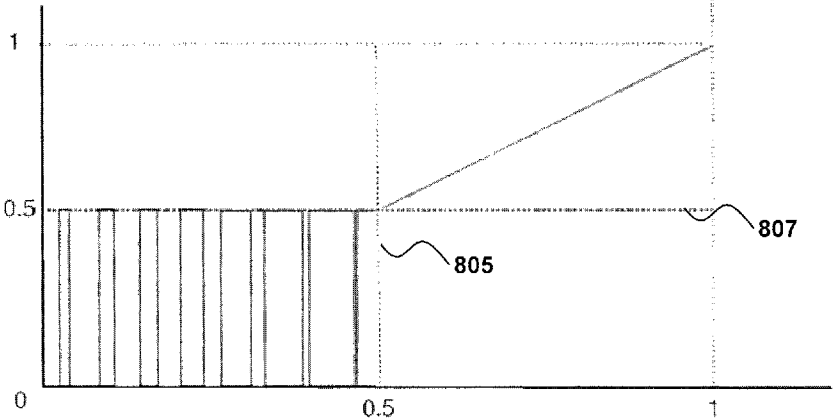

FIGS. 6 and 7 illustrate exemplary processes 600 and 700 for controlling the brightening and dimming of an LED, such as a blue LED, thereby adjusting the brightness of a quantum dot backlight (e.g., backlight 200, 300, or other backlight). Generally, process 600 and 700 can include the use of current dimming to adjust the brightness of the LED of the backlight at high luminance settings to increase the light output efficiency and can include the use of pulse width modulation to adjust the brightness of the LED at low luminance settings to reduce the amount of wavelength shift experienced by the LED. To illustrate, FIG. 8A shows an exemplary graph depicting the relationship between a relative luminance (e.g., with a relative luminance value of 0 corresponding to an off state of the LED and a relative luminance value of 1 corresponding to a maximum brightness of the LED) of the LED and the relative values of the duty cycle 803 and drive current 801 e.g., with a relative value of 0 corresponding to a 0% duty cycle and zero drive current and a relative value of 1 corresponding to a 100% duty cycle and a maximum drive current). As shown in FIG. 8A, the drive current can have a constant, or at least substantially constant (e.g., within 1%, 2%, 3%, 4%, 5%, or 10%), minimum current value 807 (e.g., 0.5) from zero relative luminance to a threshold luminance value 805 (e.g., 0.5). To adjust the luminance of the LED between relative luminance values of zero and the threshold value 805, the duty cycle 803 can be changed to generate the desired luminance. However, between the threshold luminance value 805 and a luminance value of 1, the duty cycle can have a constant, or at least substantially constant (e.g., within 1%, 2%, 3%, 4%, 5%, or 10%), value (e.g., 1). To adjust the luminance of the LED between the threshold luminance value 805 and a luminance value of 1, the drive current can be changed to generate the desired luminance. FIG. 8B illustrates a graph showing the relationship between relative forward current values through the LED and the relative luminance of the LED. It should be appreciated that the current values shown between 0 relative luminance and threshold luminance value 805 do not reflect actual current values, and instead represent relative duty cycle ratios.

In the examples shown in FIGS. 8A and 8B, the threshold luminance value 805 has been selected to be 0.5, meaning that a switch between pulse width modulation and current dimming can occur at half the maximum luminance of the LED. At luminance values below threshold luminance value 805, duty cycle 803 ranges from 0 to 1 (e.g., 0% to 100% duty cycle) between luminance values of 0 and the threshold luminance value 805 of 0.5. Additionally, at luminance values below threshold luminance value 805, drive current 801 can have a constant, or at least substantially constant, minimum current value 807 of 0.5 (representing half of the maximum drive current). At luminance values greater than the threshold luminance value 805, duty cycle 803 can be set to its maximum value of 1 (corresponding to a 100% duty cycle). Additionally, at luminance values greater than the threshold luminance value 805, the drive current 801 can range from the minimum current value 807 of 0.5 to a maximum relative value of 1.

While specific current dimming and pulse width modulation dimming parameters are shown in FIGS. 8A and 8B, it should be appreciated by one of ordinary skill that these values can be adjusted based on specific components used and desired operational characteristics of the backlight. For example, minimum current value 807 can be selected such that the dominant wave length shift between the minimum current value 807 and the maximum relative current value is less than a desired amount (e.g., as shown in FIG. 5). Additionally, the threshold relative luminance value 805 can be selected based on the selected minimum current value 807 and a desired efficiency of the backlight. For example, current dimming can be more efficient for light generation than pulse width modulation. Thus, to increase efficiency, the threshold relative luminance value 805 and minimum current value 807 can be reduced. Conversely, to improve color uniformity, the threshold relative luminance value 805 and minimum current value 807 can be increased. Given the contents of the present disclosure, one of ordinary skill can select current dimming and pulse width modulation dimming parameters based on the specific components used and desired operational characteristics of the backlight.

Referring back to FIG. 6, an exemplary process 600 for increasing the luminance of an LED within a quantum dot backlight based on the mixed-mode dimming shown in FIGS. 8A and 8B is provided. At block 601, an LED (e.g., a blue LED), such as LED 202 or 302, of a backlight, such as backlight 200 or 300, can be driven with a drive current at a duty cycle value. For example, an LED can be driven with a duty cycle value and a drive current value shown in FIG. 8A. At block 603, it can be determined if the relative luminance corresponding to the drive current and duty cycle used at block 601 is less than a threshold relative luminance value. If the luminance value is less than the threshold relative luminance value, the process can proceed to block 605. At block 605, the duty cycle of the drive current can be increased to increase the luminance of the LED. For example, as shown in FIG. 8A, if the luminance value is less than the threshold luminance value 805, the duty cycle can be increased while maintaining a constant, or at least substantially constant, drive current. The process may then return to block 603 where the blocks of process 600 can be repeated until obtaining a desired luminance.

If, however, it is determined at block 603 that the current luminance value is not less than the threshold luminance value, the process can proceed to block 607. At block 607, the drive current can be increased to increase the luminance of the LED. For example, as shown in FIG. 8A, if the luminance value is not less than the threshold luminance value 805, the drive current can be increased while maintaining a constant, or at least substantially constant, duty cycle. The process may then return to block 603 where the blocks of process 600 can be repeated until obtaining a desired luminance.

Similarly, FIG. 7 illustrates an exemplary process 700 for decreasing the luminance of an LED of a quantum dot backlight. At block 701, an LED of the backlight can be driven with a drive current at a duty cycle. For example, the LED can be driven with a duty cycle value and current value shown in FIG. 8A. At block 703, it can be determined if the relative luminance corresponding to the drive current and duty cycle used at block 701 is greater than or equal to a threshold relative luminance value. If the luminance value is greater than or equal to the threshold relative luminance value, the process can proceed to block 705. At block 705, the drive current can be decreased to decrease the luminance of the LED. For example, as shown in FIG. 8A, if the luminance value is greater than or equal to the threshold luminance value 805, the drive current can be decreased while maintaining a constant, or at least substantially constant, duty cycle. The process may then return to block 703 where the blocks of process 700 can be repeated until obtaining a desired luminance.

If, however, it is determined at block 703 that the current luminance value is not greater than or equal to the threshold luminance value, the process can proceed to block 707. At block 707, the duty cycle can be decreased to decrease the luminance of the LED. For example, as shown in FIG. 8A, if the luminance value is not greater than or equal to the threshold luminance value 805, the duty cycle can be decreased while maintaining a constant, or at least substantially constant, drive current. The process may then return to block 703 where the blocks of process 700 can be repeated until obtaining a desired luminance.

While processes 600 and 700 are shown in separate figures, it should be appreciated that both processes can be used to brighten or dim an LED within a backlight, thereby adjusting the brightness of the backlight.

Figure 9:
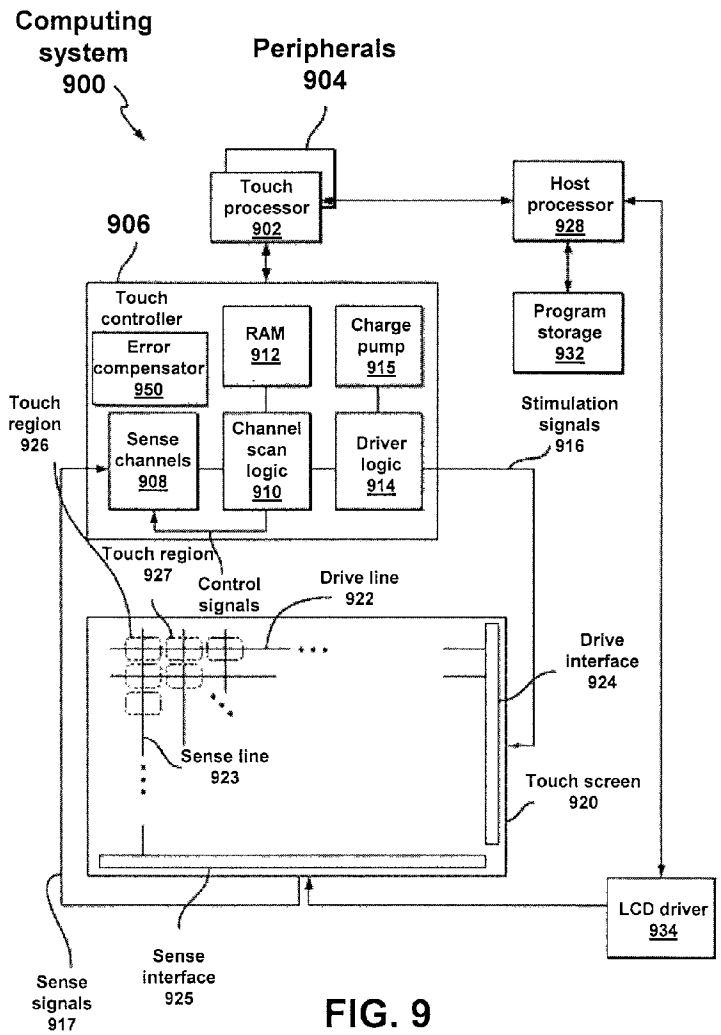
FIG. 9 is a block diagram of an example computing system that illustrates one implementation of an example display with backlight dimming control integrated with a touch screen according to examples of the present disclosure.

FIG. 9 is a block diagram of an example computing system 900 that illustrates one implementation of an example display with the backlight utilizing quantum dots described above integrated with a touch screen 920 according to examples of the disclosure. Computing system 900 could be included in, for example, a mobile telephone, digital media player, personal computer, or any mobile or non-mobile computing device that includes a touch screen. Computing system 900 can include a touch sensing system including one or more touch processors 902, peripherals 904, a touch controller 906, and touch sensing circuitry. Peripherals 904 can include, but are not limited to, random access memory (RAM) or other types of memory or storage, watchdog timers and the like. Touch controller 906 can include, but is not limited to, one or more sense channels 908, channel scan logic 910, and driver logic 914. Channel scan logic 910 can access RAM 912, autonomously read data from the sense channels and provide control for the sense channels. In addition, channel scan logic 910 can control driver logic 914 to generate stimulation signals 916 at various frequencies and phases that can be selectively applied to drive regions of the touch sensing circuitry of touch screen 920, as described in more detail below. In some examples, touch controller 906, touch processor 902 and peripherals 904 can be integrated into a single application specific integrated circuit (ASIC).

Computing system 900 can also include a host processor 928 for receiving outputs from touch processor 902 and performing actions based on the outputs. For example, host processor 928 can be connected to program storage 932 and a display controller, such as an LCD driver 934. Host processor 928 can use LCD driver 934 to generate an image on touch screen 920, such as an image of a user interface (UI), and can use touch processor 902 and touch controller 906 to detect a touch on or near touch screen 920, such a touch input to the displayed UI. The touch input can be used by computer programs stored in program storage 932 to perform actions that can include, but are not limited to, moving an object such as a cursor or pointer, scrolling or panning, adjusting control settings, opening a file or document, viewing a menu, making a selection, executing instructions, operating a peripheral device connected to the host device, answering a telephone call, placing a telephone call, terminating a telephone call, changing the volume or audio settings, storing information related to telephone communications such as addresses, frequently dialed numbers, received calls, missed calls, logging onto a computer or a computer network, permitting authorized individuals access to restricted areas of the computer or computer network, loading a user profile associated with a user's preferred arrangement of the computer desktop, permitting access to web content, launching a particular program, encrypting or decoding a message, and/or the like. Host processor 928 can also perform additional functions that may not be related to touch processing. For example, host processor 928 can control the drive current output by LCD driver 934, as described above.

Integrated display and touch screen 920 can include touch sensing circuitry that can include a capacitive sensing medium having a plurality of drive lines 922 and a plurality of sense lines 923. It should be noted that the term "lines" is sometimes used herein to mean simply conductive pathways, as one skilled in the art will readily understand, and is not limited to elements that are strictly linear, but includes pathways that change direction, and includes pathways of different size, shape, materials, etc. Drive lines 922 can be driven by stimulation signals 916 from driver logic 914 through a drive interface 924, and resulting sense signals 917 generated in sense lines 923 can be transmitted through a sense interface 925 to sense channels 908 (also referred to as an event detection and demodulation circuit) in touch controller 906. In this way, drive lines and sense lines can be part of the touch sensing circuitry that can interact to form capacitive sensing nodes, which can also be referred to as touch regions, such as touch regions 926 and 927. This way of understanding can be particularly useful when touch screen 920 is viewed as capturing an "image" of touch. In other words, after touch controller 906 has determined whether a touch has been detected at each touch region in the touch screen, the pattern of touch region in the touch screen at which a touch occurred can be thought of as an "image" of touch (e.g. a pattern of fingers touching the touch screen).

In some examples, touch screen 920 can be an integrated touch screen in which touch sensing circuit elements of the touch sensing system can be integrated into the display pixels stackups of a display.

The firmware can also be propagated within any transport medium for use by or in connection with an instruction execution system, apparatus, or device, such as a computer-based system, processor-containing system, or other system that can fetch the instructions from the instruction execution system, apparatus, or device and execute the instructions. In the context of this document, a "transport medium" can be any medium that can communicate, propagate or transport the program for use by or in connection with the instruction execution system, apparatus, or device. The transport readable medium can include, but is not limited to, an electronic, magnetic, optical, electromagnetic or infrared wired or wireless propagation medium.

Figure 10B:
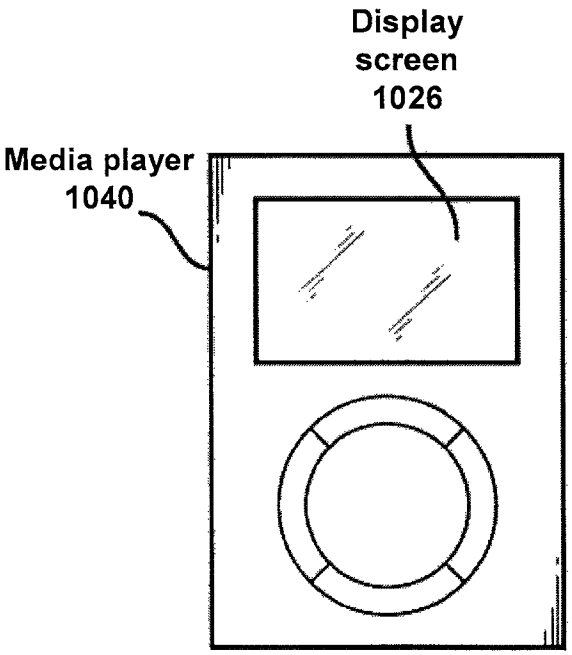
FIG. 10B illustrates an example digital media player that includes a display screen according to some disclosed examples.
Figure 10A:
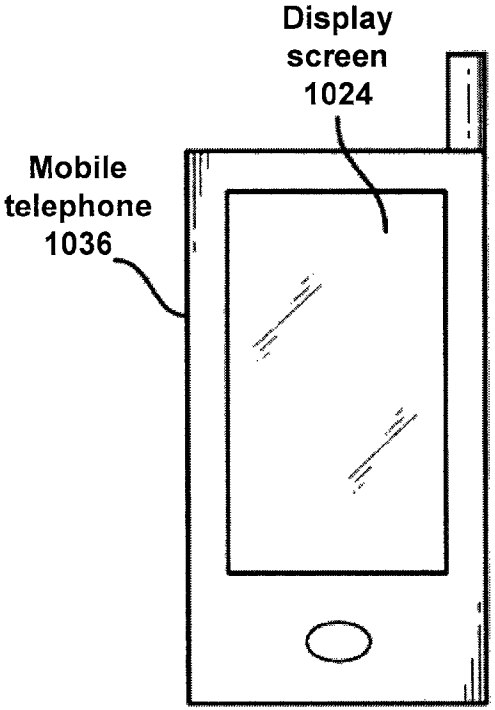
FIG. 10A illustrates an example mobile telephone that includes a display screen according to some disclosed examples.
Figure 10D:
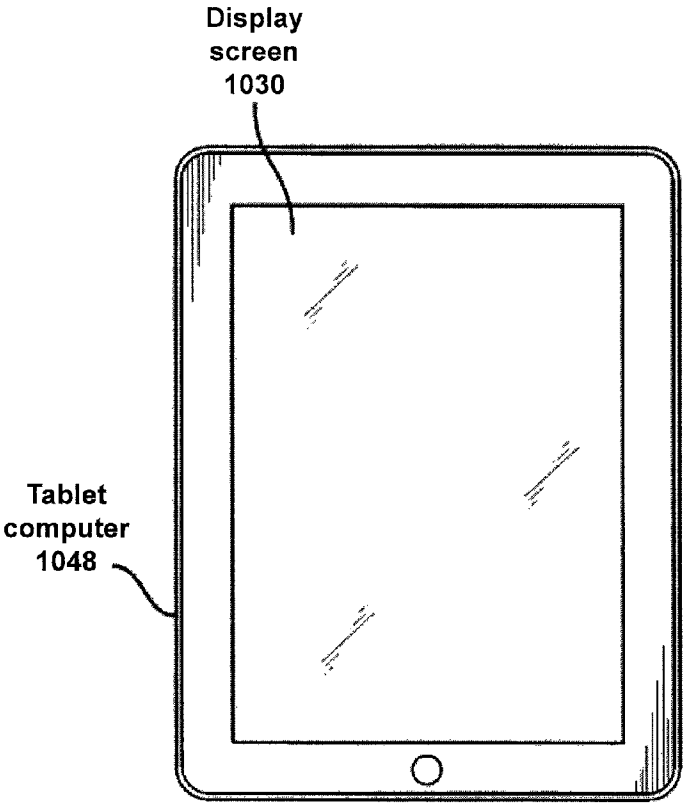
FIG. 10D illustrates an example tablet computing device that includes a display screen according to some disclosed examples.
Figure 10C:
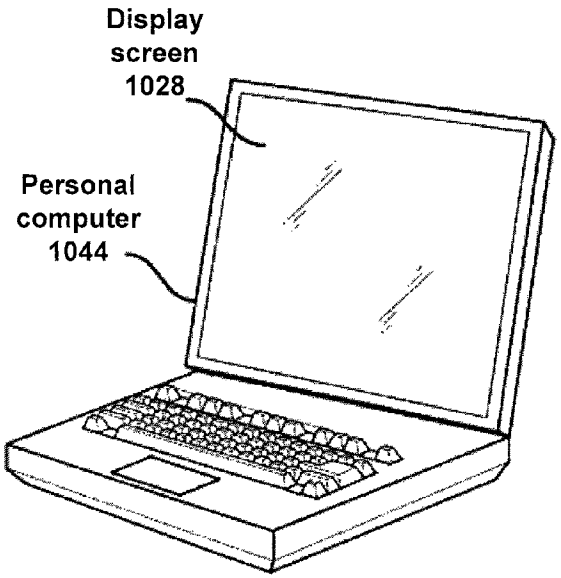
FIG. 10C illustrates an example personal computer that includes a display screen according to some disclosed examples.

FIGS. 10A-10D show example systems in which backlights and display screens (which can be part of touch screens) according to examples of the disclosure may be implemented. FIG. 10A illustrates an example mobile telephone 1036 that includes a display screen 1024. FIG. 10B illustrates an example digital media player 1040 that includes a display screen 1026. FIG. 10C illustrates an example personal computer 1044 that includes a display screen 1028. FIG. 10D illustrates an example tablet computing device 1048 that includes a display screen 1030. Display screens 1024, 1026, 1028 and 1030 can include numerous layers that are stacked on top of each other and bonded together to form the display.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the appended claims.

What is claimed is:

1. A method for forming white light within a display backlight, the method comprising:

driving a LED with a drive current, the drive current comprising a duty cycle value and a drive current value, wherein the drive current causes the LED to emit a light comprising a magnitude of luminance;

directing the emitted light to a first prism sheet;

turning the emitted light towards a diffuser sheet using the first prism sheet;

mixing the turned light using the diffuser sheet;

directing the mixed light to a quantum dot sheet, the quantum dot sheet comprising quantum dots configured to emit red and green light in response to the turned light;

mixing the emitted red and green light with a blue light to form the white light;

directing the white light to a second prism sheet;

turning the white light towards the display module using the second prism sheet; and reducing a wavelength shift of at least one of the red, green, and blue lights by:

varying the duty cycle value and maintaining the drive current value in accordance with a determination that the magnitude of luminance is less than a pre-determined magnitude of luminance threshold, and varying the drive current value and maintaining the duty cycle value in accordance with a determination that the magnitude of luminance is greater than or equal to the pre-determined magnitude of luminance threshold.

2. The method of claim 1, wherein the emitted light is blue light, and the quantum dot sheet is configured to transmit the blue light through the quantum dot sheet.

3. The method of claim 1, wherein the pre-determined magnitude of threshold is equal to 50 percent.

4. The method of claim 1, wherein varying the duty cycle value includes linearly varying the duty cycle value with the magnitude of luminance.

5. The method of claim 1, wherein varying the drive current value includes linearly varying the drive current value with the magnitude of luminance.

6. A backlight comprising:

a light emitting diode (LED);

a quantum dot sheet;

a first prism sheet located between the LED and the quantum dot sheet;

a diffuser sheet located between the first prism sheet and the quantum dot sheet;

a second prism sheet located on a side of the quantum sheet opposite the diffuser sheet;

driver circuitry operable to output a drive current to the LED, the drive current comprising a duty cycle value and a drive current value, wherein the drive current causes the LED to emit a light having a magnitude of luminance; and a controller operable to:

control the driver circuitry to reduce a wavelength shift of the LED by varying the duty cycle value and maintaining the drive current value in accordance with a determination that the magnitude of luminance of the LED is less than a pre-determined magnitude of luminance threshold, and control the driver circuitry to vary the drive current value and maintain the duty cycle value in accordance with a determination that the magnitude of luminance of the LED is greater than or equal to the pre-determined magnitude of luminance threshold.

7. The backlight of claim 6, wherein the LED comprises a blue LED.

8. The backlight of claim 7, wherein the quantum dot sheet comprises:

a first plurality of quantum dots operable to emit a red light in response to a blue light emitted from the blue LED; and a second plurality of quantum dots operable to emit a green light in response to the blue light emitted from the blue LED.

9. The backlight of claim 6, wherein varying the duty cycle value in accordance with a determination that the magnitude of luminance of the LED is less than the pre-determined magnitude of luminance threshold includes increasing the magnitude of luminance by linearly increasing the duty cycle value, and varying the drive current value in accordance with a determination that the magnitude of luminance of the LED is greater than or equal to the magnitude of luminance threshold includes increasing the magnitude of luminance by linearly increasing the drive current value.

10. A display comprising:

a liquid crystal display module;

a backlight operable to emit a light directed towards the liquid crystal display module, wherein the backlight comprises:

a light emitting diode (LED);

a quantum dot sheet;

a first prism sheet located between the LED and the quantum dot sheet;

a diffuser sheet located between the first prism sheet and the quantum dot sheet;

a second prism sheet located on a side of the quantum sheet opposite the diffuser sheet;

driver circuitry operable to output a drive current to the LED, the drive current comprising a duty cycle value and a drive current value, wherein the drive current causes the LED to emit a light having a magnitude of luminance; and a controller operable to:

control the driver circuitry to reduce a wavelength shift of the LED by varying the duty cycle value and maintaining the drive current value in accordance with a determination that the magnitude of luminance of the LED is less than a pre-determined magnitude of luminance threshold, and control the driver circuitry to vary the drive current value and maintain the duty cycle value in accordance with a determination that the magnitude of luminance is greater than or equal to the pre-determined magnitude of luminance threshold.

11. The display of claim 10, wherein the backlight is operable to emit a white light directed towards the liquid crystal display module.

12. The display of claim 10, wherein the display is integrated within a mobile phone, media player, personal computer, or tablet computer.

13. The display of claim 10, wherein the controller is operable to linearly increase only one of the duty cycle value and the drive current value at a time.

14. A method for controlling a brightness of a light emitting diode (LED) within a quantum dot display backlight, the method comprising:

driving the LED with a drive current, the drive current comprising a duty cycle value and a drive current value, wherein the drive current causes the LED to emit a light comprising a magnitude of luminance, wherein:

the duty cycle value has one or more first duty cycle values and one or more second duty cycle values greater than the one or more first duty cycle values, wherein a wavelength shift of the display backlight is reduced by setting the duty cycle value to the one or more first duty cycle values in accordance with a determination that the magnitude of luminance is less than a pre-determined magnitude of luminance threshold, and the drive current value has one or more first drive current values and one or more second drive current values greater than the one or more first drive current values, wherein an output efficiency of the LED is increased by setting the drive current value to the one or more second drive current values in accordance with a determination that the magnitude of luminance is greater than or equal to the pre-determined magnitude of luminance threshold;

directing the emitted light to a first prism sheet;

turning the emitted light towards a diffuser sheet using the first prism sheet;

mixing the turned light using the diffuser sheet;

directing the mixed light to a quantum dot sheet, the quantum dot sheet comprising quantum dots configured to emit red and green light in response to the turned light;

mixing the emitted red and green light with a blue light to form a white light;

directing the white light to a second prism sheet; and turning the white light towards a display module using the second prism sheet.

15. The method of claim 14, wherein the one or more first duty cycle values includes a plurality of duty cycle values that varies linearly with the magnitude of luminance.

16. The method of claim 14, wherein the one or more second drive current values includes a plurality drive current values that varies linearly with the magnitude of luminance.

17. The method of claim 14, wherein the one or more second duty cycle values includes 100%.

18. The method of claim 14, wherein the first drive current value is equal to half a maximum value of the drive current value.

19. The method of claim 14, wherein the pre-determined magnitude of luminance threshold is equal to half a maximum value of the LED luminance.

* * * * *